United States Patent [19]

Jarniac

[11] 4,426,912

[45] Jan. 24, 1984

[54] APPARATUS FOR THE CONTINUOUS ADJUSTMENT OF A JACK PISTON STROKE

[75] Inventor: Roger Jarniac, Caluire, France

[73] Assignee: Commissariat A l'Energie Atomique, Paris, France

[21] Appl. No.: 312,695

[22] Filed: Oct. 19, 1981

[30] Foreign Application Priority Data

Oct. 23, 1980 [FR] France ..... 80 23066

[51] Int. Cl.[3] ..... F15B 21/02; F01L 21/02

[52] U.S. Cl. ..... 91/39; 91/234; 91/235; 91/277

[58] Field of Search ..... 91/39, 40, 277, 235, 91/234

[56] References Cited

U.S. PATENT DOCUMENTS

| | | | |
|---|---|---|---|
| 2,898,890 | 8/1959 | Lynott | 91/51 |
| 2,970,570 | 2/1961 | Hill | 91/39 |
| 3,368,457 | 2/1968 | Lewakowski | 91/39 |
| 3,752,038 | 8/1973 | Inaba | 91/39 |

FOREIGN PATENT DOCUMENTS 464891 4/1937 United Kingdom .

*Primary Examiner*—Paul E. Maslousky
*Attorney, Agent, or Firm*—Michael N. Meller

[57] ABSTRACT

Apparatus for the continuous adjustment of the stroke amplitude of the piston of a jack, the latter having a control member of which at least part is in the form of a rod, which is movable in rotation and in translation and cooperates with the said piston, wherein said rod has an extension in the form of a differential piston which is movable in translation and in rotation within a cylinder and defining also in the latter a chamber with a large cross-section and a chamber with a small cross-section, the latter being permanently connected to a pressurized fluid source, said differential piston having an inner cavity in which is located a second rod immobilized in translation and which can be angularly oriented, said second rod being provided with a cam having two opposite edges which can cyclically uncover and cover, during the rotation of the differential piston, at least two openings respectively connected to the two chambers.

3 Claims, 5 Drawing Figures

FIG. 2
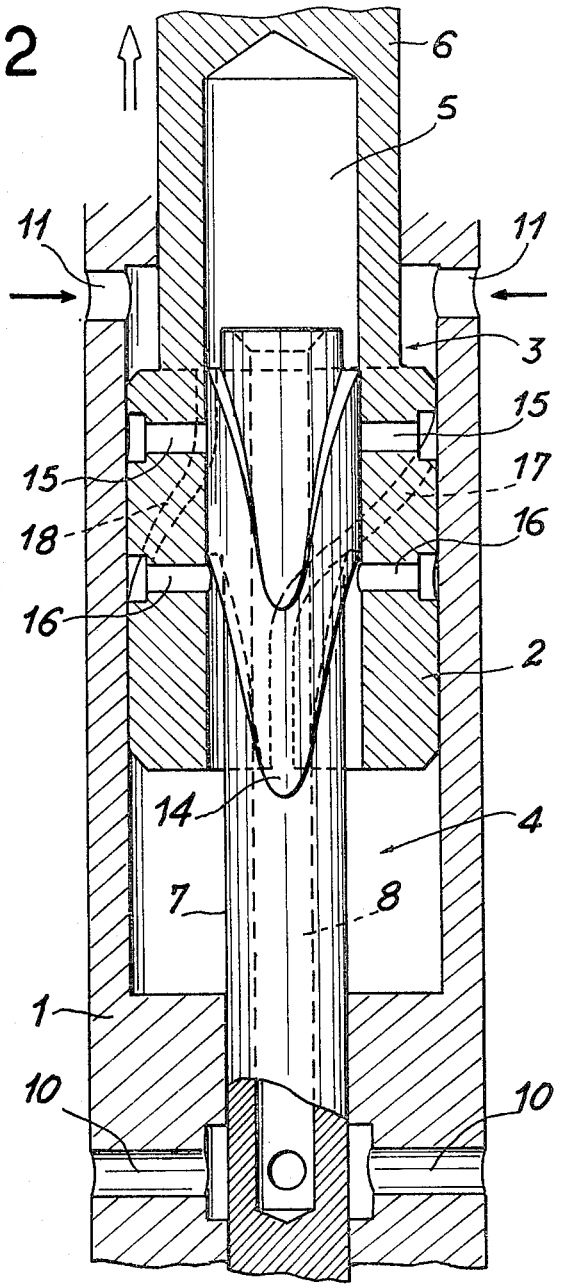
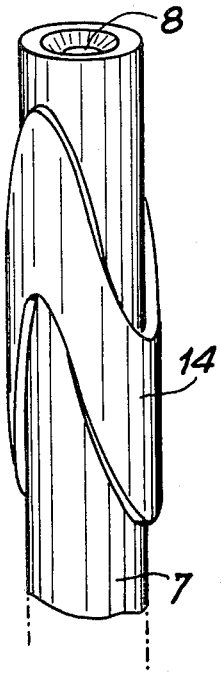
FIG. 4

APPARATUS FOR THE CONTINUOUS ADJUSTMENT OF A JACK PISTON STROKE

BACKGROUND OF THE INVENTION

The present invention relates to an apparatus making it possible to continuously adjust the stroke of the piston of a jack, usable more particularly in the case of a differential piston.

At present, various apparatus types exist which make it possible to modify the length of a piston stroke. For example, U.S. Pat. No. 2,898,890 describes such an apparatus in which compressed air can be blown into each of the ends of a cylinder within which displacement of the piston takes place. A plurality of discharge ports, sealed by valves, are distributed along the cylinder. The opening of one of these valves leads to a pressure drop on one side of the piston and, due to an appropriate system, the compressed air is despatched from the other side of the piston, which then moves back level with the selected port. In this way, a rough adjustment of the piston stroke is obtained by choosing the discharge port. However, this apparatus has a certain number of disadvantages. Firstly, it does not permit a continuous variation of the displacement amplitude. In addition, the installation is relatively complex and therefore costly, because there are a large number of discharge ports and each of the closing valves is controlled by a solenoid.

BRIEF SUMMARY OF THE INVENTION

The present invention aims at obviating these disadvantages by proposing a simple apparatus, which makes it possible to vary in a continuous manner the stroke of the piston.

According to the main feature of the apparatus for the continuous adjustment of the stroke amplitude according to the invention, said piston forming part of a jack comprising a control member, at least part of which is in the form of a rod movable in rotation and in translation and cooperating with the said piston, said rod has an extension in the form of a differential piston which is movable in translation and in rotation within a cylinder and defining in the latter a chamber with a large cross-section and a chamber with a small cross-section, the latter being permanently connected to a pressurized fluid source said differential piston having an inner cavity in which is located a second rod immobilized in translation and which can be angularly oriented, said second rod being provided with a cam having two opposite edges which can cyclically uncover and cover, during the rotation of the differential piston, at least two openings respectively connected to the two chambers.

According to another feature of this apparatus, the second rod has a cavity which, by means of the said openings, makes it possible to link the chamber with the large cross-section with a discharge of fluid.

Finally, according to a further feature of the apparatus, the differential piston comprises an outer wall in which are made at least two grooves, the ends of one of these grooves issuing into one of the said openings and into the chamber with the large cross-section respectively, the ends of the other groove issuing respectively into the other opening and into the chamber with the small cross-section.

The invention is described in greater detail hereinafter relative to a non-limitative embodiment in which the apparatus according to the invention is applied to a programmed control actuating jack itself having a differential piston controlled by a rod equipped with a cam.

The operating principle of such a jack is the same as that of the adjustment apparatus according to the invention, so that firstly the operation of the jack will be described and it will then be shown how the piston stroke can be modified by means of the apparatus according to the invention.

BRIEF DESCRIPTION OF THE DRAWINGS

The invention is described in greater detail hereinafter relative to the drawings, wherein show:

FIGS. 2 and 3 partly reproducing FIG. 1 in two different positions of the moving piston.

FIG. 4 a perspective view of the cam carried by the jack control rod according to FIGS. 1 to 3.

DETAILED DESCRIPTION OF THE PREFERRED EMBODIMENTS

Figure 1:
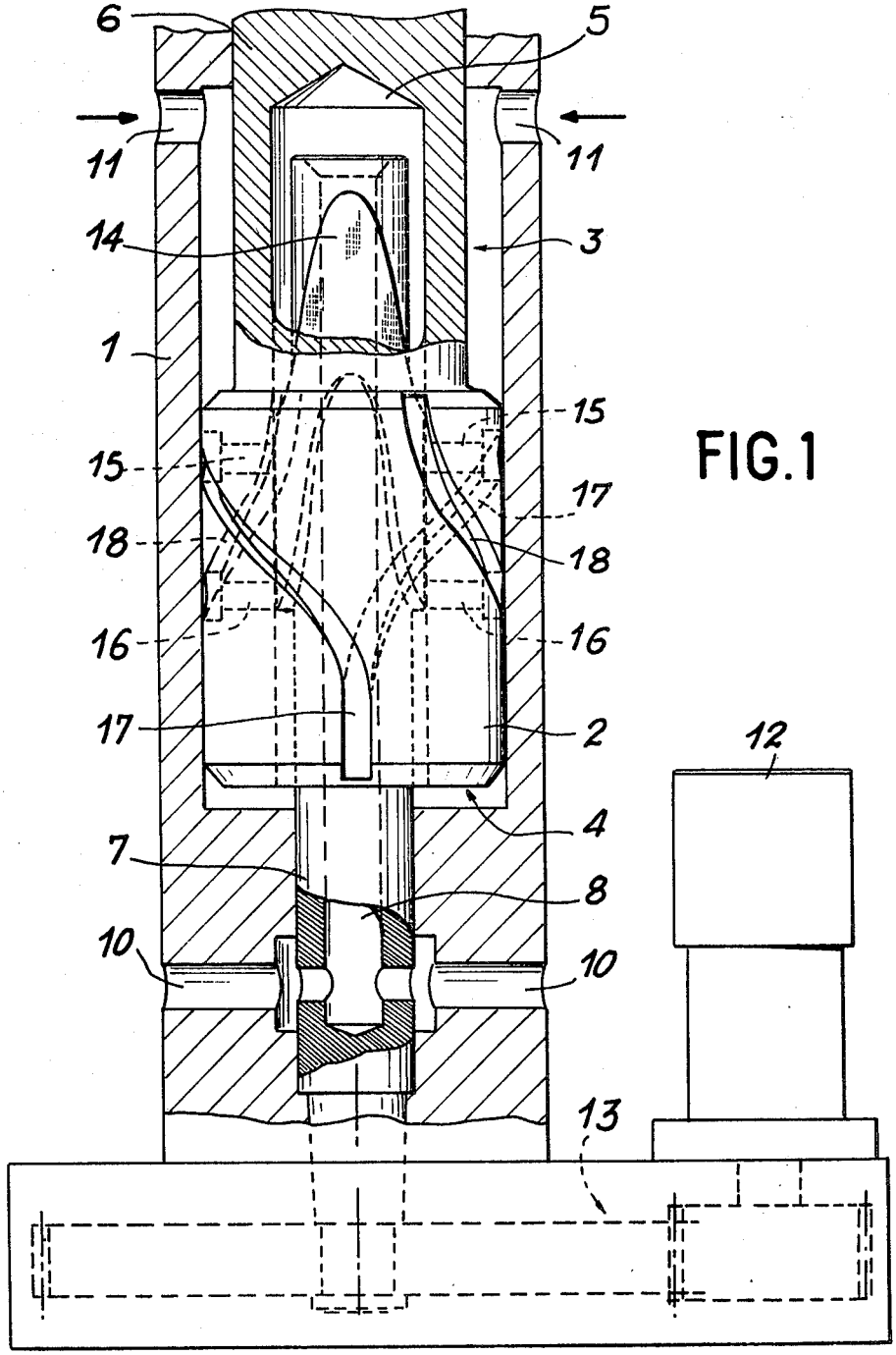
FIG. 1 a diagrammatic axial section of the hydraulic jack, whose actuation is programme-controlled.
Figure 3:
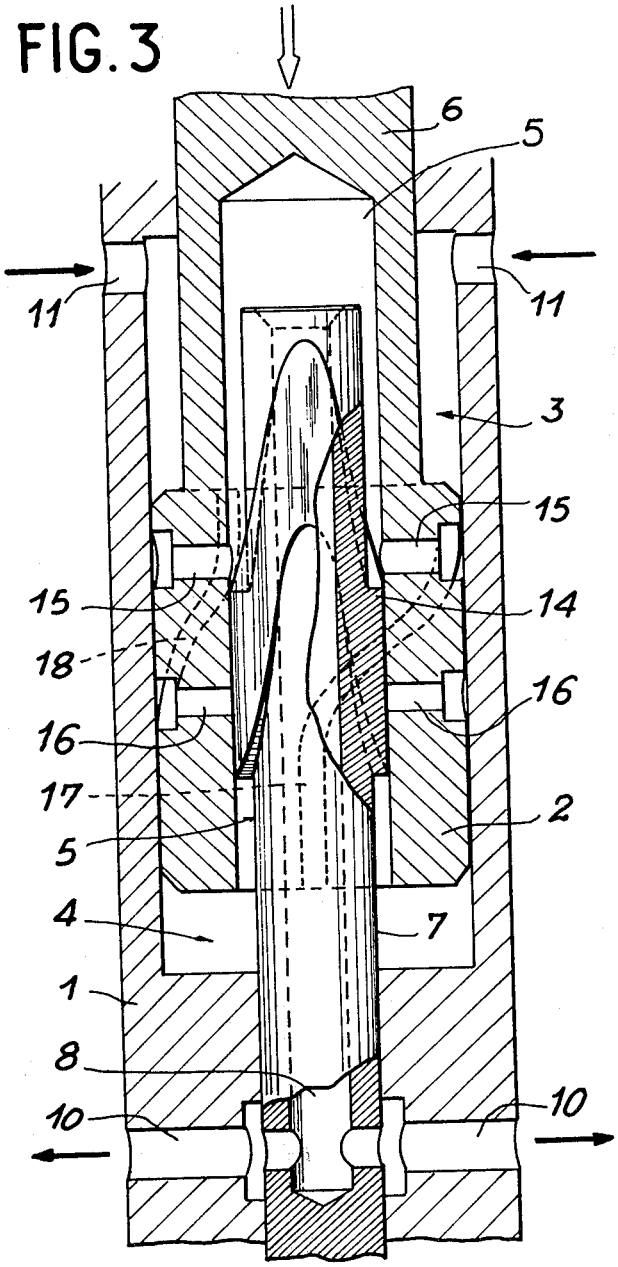

The jack shown in FIGS. 1 to 3 comprises a tubular cylindrical body 1 in the axial bore of which is slidingly mounted a piston 2, which thus defines two opposite chambers 3 and 4. Piston 2 is itself tubular and the axial bore 5 defined in this way extends partly into the member 6 operated by the said piston. Within the blind bore 5 engages a smaller diameter shaft or rod 7 having an axial channel 8, whereof one end issues into the blind part of bore 5, whilst the opposite end is connected by radial perforations to two discharge or exhaust ports 10 connected to the low pressure of the hydraulic installation.

As the member 6 has a larger diameter than shaft 7, piston 2 can be called "differential". Although the two chambers have the same diameter, chamber 3 will be subsequently called "small cross-section", whilst chamber 4 will be called "large cross-section". It should be noted that chamber 3 with the small cross-section is permanently connected to a fluid source under high pressure by means of two radially opposite ports 11. Moreover, shaft 7 is extended beyond the discharge ports 10 so as to pass axially out of jack cylinder 1 and receive the drive of a motor 12 associated with an appropriate transmission 13.

The part of shaft 7 engaged in bore 5 is integral by machining or fixing with a cam 14, whose profile is clearly shown in FIG. 4. In the present embodiment, it has a double sinusoidal profile extending symmetrically in two parts about the cylinder formed by the shaft. Cam 14 opposes the link between chamber 4 with the large cross-section and discharge channel 8 and its two opposite edges serve to form closing members for two pairs of radial openings 15 and 16 made in the thickness of piston 2. Each of the openings 15 is connected by a peripheral groove 17 to chamber 4 with the large cross-section, whilst similar grooves 18 link opening 16 with the chamber 3 having the small cross-section, it being understood that the two pairs of grooves 17, 18 are profiled in such a way that they do not intersect.

The operation of the jack can be gathered from the aforementioned explanations and is readily apparent.

In FIG. 1, it is assumed that motor 12 associated with shaft 7 is stopped and that cam 14 has an orientation such that the four openings 15 and 16 are covered by the edges of the cam and therefore sealed. The high pressure fluid, which, in this embodiment, is a hydraulic liquid, enters the small cross-section chamber 3 and tends to force piston 2 downwards, but as the opposite chamber 4 is separated by cam 14 from discharge port 10, said piston remains stationary.

However, if in the manner shown in FIG. 2, motor 12 is started up and drives shaft 7 and cam 14 in a dextrorotatory manner, the edge of the lower lip of said cam will uncover the two openings 16. Thus, the hydraulic liquid can pass from chamber 3 into chamber 4 through the aforementioned openings 16 and grooves 18. As chamber 4 has a larger useful cross-section, piston 2 moves upwards. Obviously, this axial displacement of the piston tends to bring opening 16 below of the lower edge of cam 14. However, as the latter is driven in rotation, said openings remain uncovered until the cam has performed a 90° rotation.

At this time and as illustrated in FIG. 3, openings 16 are sealed by the lower edge of cam 14, whilst the upper edge of the latter uncovers the two openings 15. Thus, chamber 4 is linked with low pressure across grooves 17, openings 15, channel 8 and ports 10, whilst high pressure is exerted on the upper face of the piston which, consequently, moves downwards. This downward movement of piston 2 and member 6 continues for a time corresponding to a 90° rotation of shaft 7, so that the position of FIG. 1 is restored and new operating cycle can take place.

It is obvious to provide sealing members for preventing any parasitic link between the chambers of the cylinder and the openings of piston 2 during the sliding of the latter. In the same way, it is indispensible to associate with said piston angular immobilization means during its alternating displacement. As a result of these precautions, a perfect operation of the jack is obtained and its member 6 is forced to follow a clearly defined movement law, which is a function of the profile of rotating cam 14.

Figure 5:
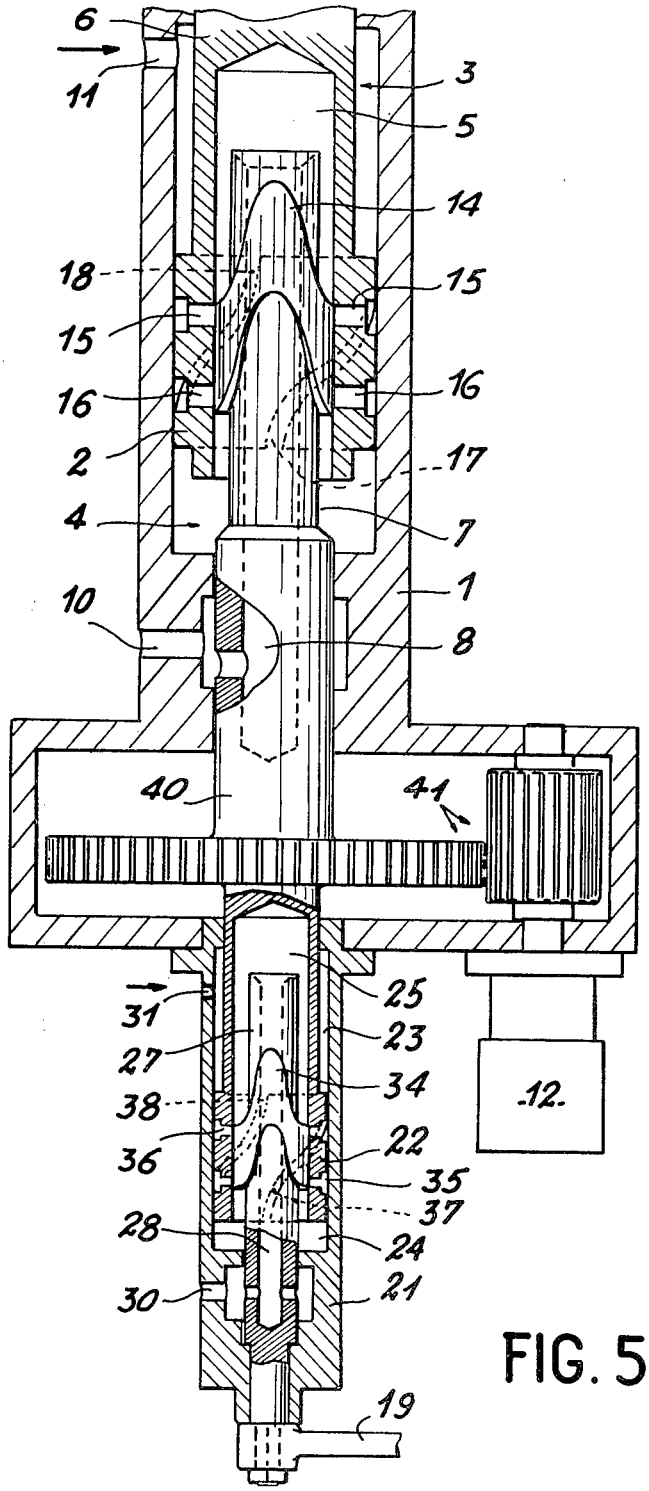
FIG. 5 a jack associated with an adjustment apparatus according to the invention.

FIG. 5 shows how such a jack can be associated with an adjustment apparatus according to the invention. In FIG. 5, it is possible to see cylinder 1 with its radial ports 10 and 11 for its connection with the hydraulic installation, differential piston 2 with radial openings 15 and 16, connecting grooves 17, 18 and rotary cam 14, which is carried by shaft 7 mounted so as to rotate in the axial blind bore 5 of said piston. However, shaft 7 which carries cam 14 is in this case integral with a member 40, which is extended axially downwards to form the piston 22 of a second programmed control hydraulic jack.

Piston 22 is similar to piston 2. It is slidingly mounted in a cylinder 21 provided with ports 31 and 30 respectively connected to the high and low pressures of the overall installation. Piston 22 is a differential piston defining in cylinder 21 a small cross-section chamber 23 and a large cross-section chamber 24. In the blind bore 25 of piston 22 engages a cam 34 carried by a second rod 27, which does not effect a rotary movement. Rod 27 passes beyond the free transverse face of cylinder 21 and is equipped with a member permitting the regulation of its orientation, said member being diagrammatically shown in the form of a lever 19. Piston 22 carries openings 35, 36 and grooves 37, 38, which fulfil the same function as openings 15, 16 and grooves 17, 18 of piston 2.

Obviously, extension 40 of rod 7 must be rotated by motor 12, without said driving movement opposing its axial displacement under the action of piston 22. The transmission placed between motor 12 and member 40 is consequently formed by two pinions or toothed wheels 41 having straight teeth.

The operation of the assembly shown in FIG. 5 is obvious. The upper jack functions in the same way and under the same conditions as in FIGS. 1 to 3, so that member 6 moves alternately upwards and downwards as a function of the programme imparted by rotary cam 14. For the lower cam, the rotation of piston 22 to some extent takes the place of that of the cam and consequently piston 22 slides axially. By modifying the angular position of cam 34 in piston 22, lever 19 makes it possible to adjust the precise time at which the stroke of piston 22 takes place, as opposed to the amplitude of the stroke thereof. Thus, under these conditions, as a function of the displacement of the two jacks of the assembly shown in FIG. 5, it is possible to have the stroke of one added to the stroke of the other or to be deducted therefrom, so that the user is able to precisely adjust the amplitude of displacement of member 6 carried by piston 2.

As stated hereinbefore, the arrangement of the apparatus according to FIG. 5 has been very diagrammatically shown and it is necessary to provide joints, fittings or other means for ensuring the sealing of the sliding action of pistons 2 and 22.

It is obvious that the invention is not limited to the embodiments described and represented herein and numerous variants thereof are possible without passing beyond the scope of the invention. In particular, certain technical details can be replaced by equivalent details. Finally, although a special application in which the apparatus according to the invention is associated with a differential piston has been described, said apparatus can be used for any type of jack, whose piston is provided with a control member.

What is claimed is:

1. An apparatus for the continuous adjustment of the stroke amplitude of a piston of a jack, the latter having a control member of which at least part is in the form of a rod, which is movable in rotation and in translation and cooperates with the said piston, wherein said rod has an extension in the form of a differential piston which is movable in translation and in rotation within a cylinder and defining also in the latter a chamber with a large cross-section and a chamber with a small cross-section, the latter being permanently connected to a pressurized fluid source, said differential piston having an inner cavity in which is located a second rod immobilized in translation and which can be angularly oriented, said second rod being provided with a cam having two opposite edges which can cyclically uncover and cover, during the rotation of the differential piston, at least two openings respectively connected to the two chambers.

2. An apparatus according to claim 1, wherein the second rod has a cavity which, by means of the said openings, makes it possible to link the chamber with the large cross-section with a discharge of fluid.

3. An apparatus according to claims 1 or 2, wherein the differential piston comprises an outer wall in which are made at least two grooves, the ends of one of these grooves issuing into one of the said openings and into the chamber with the large cross-section respectively, the ends of the other groove issuing respectively into the other opening and into the chamber with the small cross-section.

* * * * *